United States Patent [19]

Redekop

[11] Patent Number: 4,968,032

[45] Date of Patent: Nov. 6, 1990

[54] HOCKEY STICK SHAFT

[75] Inventor: Alfred W. Redekop, Langley, Canada

[73] Assignee: MacMillan Bloedel Limited, Canada

[21] Appl. No.: 337,658

[22] Filed: Apr. 13, 1989

[51] Int. Cl.[5] ..... A63B 59/12

[52] U.S. Cl. ..... 273/67 A; 273/73 J; 273/DIG. 7

[58] Field of Search ..... 273/72 R, 67 A, 73 F, 273/DIG. 7, 62 R, 80 R, 73 J; 156/185

[56] References Cited

U.S. PATENT DOCUMENTS

| | | | |
|---|---|---|---|
| 2,428,325 | 9/1947 | Collins | 273/73 F |
| 3,691,000 | 9/1972 | Kalnin | 273/73 F |
| 4,052,499 | 10/1977 | Goupil et al. | 273/67 A |
| 4,134,587 | 1/1979 | Diederich | 273/67 A |
| 4,159,114 | 6/1974 | Ardell et al. | 273/67 A |
| 4,537,398 | 8/1985 | Salminen | 273/67 A |

FOREIGN PATENT DOCUMENTS

| | | | |
|---|---|---|---|
| 591454 | 1/1960 | Canada . | |
| 1058240 | 7/1979 | Canada . | |
| 1072142 | 2/1980 | Canada . | |
| 1138912 | 1/1983 | Canada . | |
| 1145371 | 4/1983 | Canada . | |
| 1151693 | 8/1983 | Canada . | |
| 1207350 | 7/1986 | Canada . | |
| 3437165 | 4/1986 | Fed. Rep. of Germany | 273/67 A |
| 42515 | 4/1970 | Finland . | |

OTHER PUBLICATIONS

"Dynaglas", The Sporting Goods Dealer; Mar., 1976, pp. 60,61.

*Primary Examiner*—Edward M. Coven
*Assistant Examiner*—Mark S. Graham

[57] ABSTRACT

A hockey stick shaft is formed by a central wood core, a pair of fibre reinforcing layers reinforcing a pair of opposite sides of the core, a pair of intermediate wood layers one over each of the reinforcing layers in turn covered by a second pair of reinforcing layers positioned one over each of the intermediate layers and a pair of outer surface layers are laminated to each of the second reinforcing layers.

Preferably the second reinforcing layers have a higher tensile strength than the first reinforcing layers.

13 Claims, 1 Drawing Sheet

HOCKEY STICK SHAFT

FIELD OF THE INVENTION

The present invention relates to a laminate for forming a hockey stick. More particularly the present invention relates to a hockey stick shaft structure and in particular to a hockey stick.

BACKGROUND OF THE PRESENT INVENTION

Reinforcement of hockey stick shafts and the formation of reinforced hockey sticks have been accomplished by using a variety of different laminated structures and combinations. It is important that the hockey stick be relatively light and yet the shaft have a very high stiffness to permit good puck handling while improving the effectiveness of slap shots.

One of the earlier developments in reinforcing hockey sticks with fiberglass is disclosed in Canadian patent No. 591,454 issued Jan. 26, 1960 to Vaillet. In this patent a hockey stick blade is covered on opposite sides by a thin plastic layer which in turn is covered by a reinforcing of fiberglass. Apparently this structure was followed by a structure as described in Finnish patent No. 42,515 issued Apr. 30, 1970 which describes a structure similar to that of Canadian Patent No. 591,454 but further includes a birch veneer layer overlying the fiberglass and forming the outer surface of the shaft. A similar structure is also shown, for example, in Canadian Patent No. 1,058,240 issued July 10, 1979 to inventor Tiltola.

Other techniques for reinforcing hockey stick shafts include the application of plastic fibre reinforced layers to the sides of the shaft in a variety of different ways (see Canadian patent Nos. 1,145,371 issued Apr. 26, 1983 to Buchana et al, 1,151,693 issued Aug. 9, 1983 to Goupil et al and 1,207,350 issued July 8, 1986 to Drolet et al and U.S. Pat. No. 4,147,767 issued June 7, 1983 to Ardell et al).

The use of fibre reinforcing for the blade and the joint between the blade and the shaft is also known, for example, as shown in Canadian patent Nos. 1,072,142 issued Feb. 19, 1980 to Diederich and 1,138,912 issued Jan. 4, 1983 to Harwell.

BRIEF DESCRIPTION OF THE PRESENT INVENTION

It is an object of the invention to provide a reinforced laminate for the manufacture of hockey stick shafts and to a hockey stick incorporating a shaft formed from such material.

Broadly the present invention relates to a laminate for forming hockey stick shafts comprising a central substantially rectangular core having a pair of major opposed surfaces and a pair of minor opposed surfaces, a pair of reinforcing layers applied one to each of said major surfaces, a pair of intermediate wood layers one covering the surface of each of said first reinforcing layers remote from said core, at least one second fibre reinforcing layer positioned on the outside of at least one of said intermediate layers and a pair of outer wood surface layers forming the outer major surfaces of said shafts.

Preferably the material forming said at least one second fibre reinforcing layer will have a higher tensile strength than the material forming said first reinforcing layers.

Preferably a pair of second reinforcing layers will be provided one on the outside of each of said intermediate layers.

Preferably a third reinforcing fibre layer will be interposed between at least one of said second reinforcing fibre layers and its adjacent said outer surface layer.

A hockey stick shaft formed from said laminate material and provided at one end with a groove formed in said central core at a heel end of said shaft and extending between said minor surfaces, said shaft being tapered to reduce in thickness between said major surfaces on each side of said groove tapering from a maximum thickness spaced further from said heel than the depth of said groove and said first reinforcing layers extending on opposite sides of said groove.

Preferably said second reinforcing layers will be exposed by said taper.

Preferably a tongue of a blade will be secured within said groove to form a joint between said shaft and said blade and a suitable reinforcing material will surround said shaft at least from adjacent said heel for a distance along said shaft greater than the depth of said groove and will reinforce said joint.

Preferably said reinforcing material will be secured to said exposed ends of said reinforcing layers.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
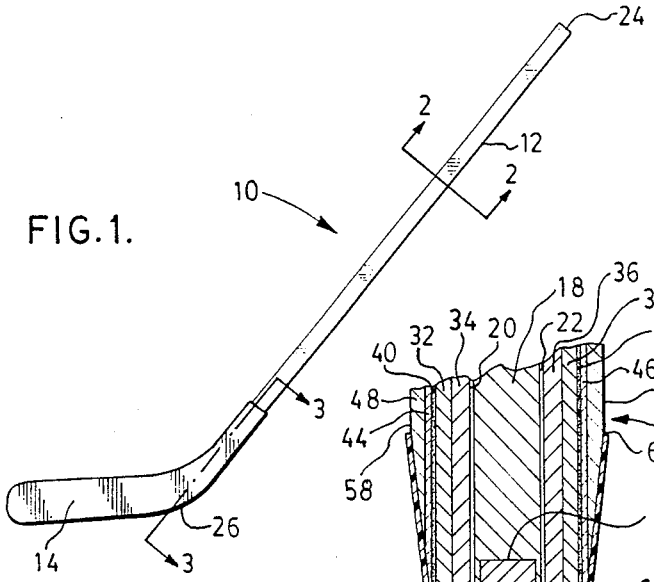
FIG. 1 is an illustration of a hockey stick constructed in accordance with the present invention.

The hockey stick 10 is composed of two main parts; a shaft 12 and a blade 14. The shaft 12 is a laminate and is formed by severing, i.e. sawing shaft 12 from a large laminated panel 16 which will be divided into a plurality of separate and distinct shafts 12, i.e. the laminated panel from which the shafts are formed is made in a panel lay-up for example 4 feet by 5 feet long with all of the various layers of the laminated panel in their proper position and is cured under heat and pressure to secure the layers of the laminate together in a process similar to the process used for making plywood.

Figure 2:
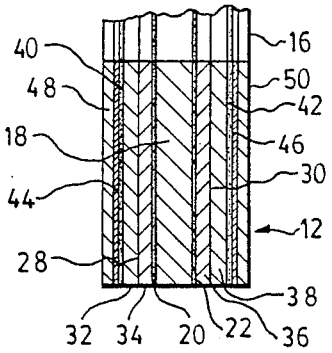
FIG. 2 is a section along the line 2—2 of FIG. 1

As shown in FIG. 2 the panel 16 and thus the shaft 12 cut therefrom is composed of a central core (see also FIG. 3) 18 formed of a suitable wood such as solid aspen, reinforced on both its major outer faces by a pair of fibre reinforced layers 20 and 22 which preferably will be formed from fiberglass with the fibres oriented longitudinally parallel to the longitudinal axis of the shaft 12, i.e. from the butt end 24 to the heel 26 as shown in FIG. 1.

A pair of intermediate layers 28 and 30 cover the reinforcing layers 20 and 22 respectively. In the illustrated arrangement, the layer 28 is formed by a pair of discrete layers 32 and 34 and the intermediate layer 30 is formed by a pair of discrete layers 36 and 38 secured together in the pressing process to make the panel 16 by an adhesive bond therebetween.

In the illustrated arrangement a second pair of reinforcing layers formed of a suitable fibre material such as fiberglass as described above with the fibres having their longitudinal axes substantially aligned along the length of the shaft 12 from the butt end 24 to heel end 26 are positioned on the outside of each of the layers 28 and 30 as indicated at 40 and 42 respectively. Preferably a further pair of fibre reinforcing layers 44 and 46 are positioned one in overlying relationship with each of the layers 40 and 42 respectively. The further reinforcing layers 44 and 46 are formed of reinforcing fibres stronger than those in the reinforcing layers 20, 22, 40 and 42 and preferably will be carbon fibres. Similar to the fibres in the other fibre reinforcing layers 20, 22, 40 and 42, the carbon fibres in the layers 44 and 46 are substantially aligned axially of the shaft 12 from the butt 24 to the heel 26.

If desired the reinforcing layers 40 and 42 may be omitted and only the layers 44 and 46 provided or alternatively the layers 44 and 46 omitted and only the layers 40 and 42 provided. It is also possible to construct the stick for either a right hand player or a left hand player and provide a reinforcing layer 40, 42, 44 or 46 only on the leading side of the shaft for the right hand or left hand player, i.e. the reinforcing layers 42 or 46 or both might be omitted and in the other case the reinforcing layers 40 or 44 omitted depending on mounting of the shaft on the blade and the curvature of the blade defining a hockey stick for a left or right hand player.

A pair of surface layers 48 and 50 define the exposed major surfaces of the shaft and protect fibre reinforcing layers 40, 44, 42 and 46.

Normally the wood layers will comprise, centre layer 18 of solid aspen, layers 32, 34, 36 and 38 of birch veneer and surface layers 48 and 50 also of birch veneer. All of the layers including the fibre reinforcing layers and the wood layers are secured together by a suitable resin adhesive by the application to the lay-up of the laminate layers of heat and pressure to cure the adhesives with the layers compressed together.

Figure 3:
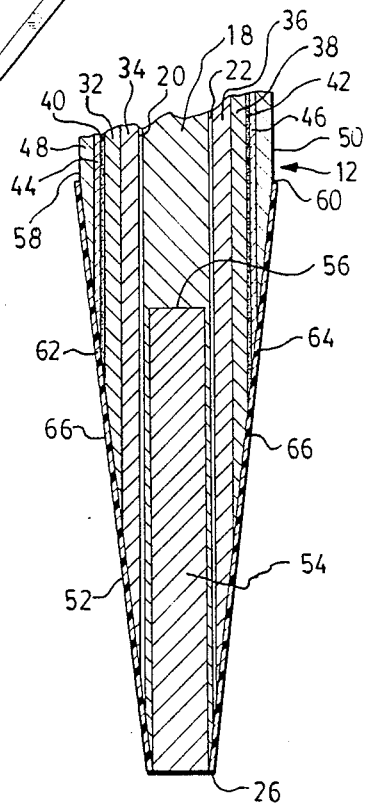
FIG. 3 is a section along the lines 3—3 of FIG. 1.

Each shaft 12 is tapered on its major faces adjacent its heel end 26 as shown in FIG. 3 from a maximum at the surface layers 48 and 50 to a minimum about equal to the thickness of the core layer 18 at the heel end 26.

At the heel end 26 of the shaft 12 a groove or slot 52 is cut into the core layer 18 from one minimum face of the shaft 12 formed by the side edges of the layers of the shaft to the opposite minor face of the shaft 12 and a tongue 54 of the blade 14 is received within this slot or groove 52 and secured therein with adhesive to connect the blade 14 to the shaft 12. This connecting structure provides a significantly stronger and better reinforced hockey stick since as will be apparent the reinforcing layers 20 and 22 extend on opposite sides of the groove 52 substantially down to the heel 26, i.e. substantially the full depth of groove 52 from the base 56 to the heel 26 to add reinforcing along substantially the full depth of the groove 52. The layers 20 and 22 function primarily to reinforce the shaft 12 in the area of the groove and thus must extend beyond the depth of the groove 52 from heel 26 but need not extend the full length of the shaft 12 from heel 26 to butt 24 although this structure is preferred. For example these layers may extend 6 to 12 inches along the shaft between the base 56 and the butt 24 and at least one half the distance between the heel 26 and base 56.

The shaft 12 on opposite sides of the groove 52 is tapered from a thickness slightly wider than the groove 52 at the heel end 26 to the full width of the shaft 12 at a position above bottom or base 56 of the groove 52, i.e. to the position as indicated at 58 and 60 in FIG. 3. Such tapering of the end of the shaft 12 adjacent the heel 26 exposes the end edges of the reinforcing layers 40, 42, 44 and 46 as indicated at 62 and 64 on each side of the shaft 12 and may in some cases also expose the ends of the reinforcements 20 and 22 as indicated at 59 and 61.

In the illustrated arrangement, these exposed areas 62 and 64 of the reinforcing layers 40, 42, 44 and 46 are located between the heel 26 and the base 56 of groove 52. However, in many cases, the taper will be such that these areas 62 and 64 are spaced from the heel 26 a distance greater than the depth of groove 52, i.e. beyond the base 56 of the groove.

Preferably a suitable resin impregnated fibre reinforcing layer 66 will surround the shaft 12 and blade 14 and will extend up the shaft 12 from the butt 26 a distance well beyond the exposed areas 62 and 64 of the reinforcing layers and beyond the bottom or base 56 of the groove 52 so that the resin impregnated reinforcing material 66 may be secured directly to the reinforcing layers 40, 42, 44 and 46 (depending on which of these reinforcing layers are incorporated into the particular shaft used to make the hockey stick) to reinforce the shaft in the area of the groove 52.

It will be evident that the grain direction in all of those layers made from wood will be parallel to the longitudinal axis of the shaft 12, i.e. from the butt end 24 to heel 26.

The description and drawings provided hereinabove are for the purpose of illustration and as an aid to understanding and are not intended as a definition of the limits of the invention.

Modifications will be evident to those skilled in the art without departing from the spirit of the invention as defined in the appended claims.

We claim:

1. A hockey stick comprising a laminated shaft having a heel end and a butt end, a central substantially rectangular wooden core having a pair of major opposed laterally outwardly facing surfaces and a pair of minor opposed surfaces, a pair of first reinforcing fibre layers secured directly one to each of said major outwardly facing surfaces and extending along said core from said heel end toward said butt end, a pair of intermediate wooden layers one secured directly to the surface of each of said first reinforcing layers remote from said core, a second reinforcing fibre layer secured directly to the surface of one of said intermediate layers remote from said core and a pair of outer surface layers forming the outer major surfaces of said shaft, means forming a groove in said central core at said heel end of said shaft, said groove having a pair of opposed substantially parallel sides each extending between said minor surfaces, said shaft being tapered to reduce its thickness between said major surfaces on each side of said groove from a maximum thickness spaced further from said heel end than the depth of said groove measured along said shaft from said heel end toward said butt end to a minimum thickness at said heel end and said first reinforcing layers extending one adjacent to each of said opposed sides of said groove.

2. A hockey stick as defined in claim 1 wherein said one second fibre reinforcing layer is formed of material that has a higher tensile strength than material from which said first reinforcing layers are formed.

3. A hockey stick as defined in claim 1 further comprising a further second reinforcing layer secured directly to the surface remote from said core of the other of said pair of intermediate layers.

4. A hockey stick as defined in claim 1 further comprising a third reinforcing fibre layer interposed between and secured directly to said second reinforcing fibre layer and its adjacent said outer surface layer.

5. A hockey stick as defined in claim 3 further comprising a pair of third reinforcing fibre layers one of said pair of third fibre reinforcing layers being interposed between each of said pair of said second reinforcing fibre layers and its respective adjacent said outer surface layer.

6. A hockey stick as defined in claim 4 wherein said third fibre reinforcing layer is formed of material that has a higher tensile strength than material from which said first reinforcing layers are formed.

7. A hockey stick as defined in claim 5 wherein said pair of third fibre reinforcing layers are formed of material that has a higher tensile strength than material from which said first reinforcing layers are formed.

8. A hockey stick as defined in claim 1 further comprising a blade having a tongue, said tongue being received and secured within said groove to form a joint between said shaft and said blade and a reinforcing material surrounding said shaft at least from a location adjacent said heel end for a distance along said shaft greater than the depth of said groove thereby to reinforce said joint.

9. A hockey stick as defined in claim 2 further comprising a blade having a tongue, said tongue being received and secured within said groove to form a joint between said shaft and said blade and a reinforcing material surrounding said shaft at least from a location adjacent said heel end for a distance along said shaft greater than the depth of said groove thereby to reinforce said joint.

10. A hockey stick as defined in claim 9 wherein said reinforcing material is secured to ends of said reinforcing layers exposed along said taper.

11. A hockey stick as defined in claim 3 further comprising a blade having a tongue, said tongue being received and secured within said groove to form a joint between said shaft and said blade and a reinforcing material surrounding said shaft at least from a location adjacent said heel end for a distance along said shaft greater than the depth of said groove thereby to reinforce said joint.

12. A hockey stick as defined in claim 11 wherein said reinforcing material is secured to ends of said reinforcing layers exposed along said taper.

13. A hockey stick as defined in claim 4 further comprising a blade having a tongue, said tongue being received and secured within said groove to form a joint between said shaft and said blade and a reinforcing material surrounding said shaft at least from a location adjacent said heel end for a distance along said shaft greater than the depth of said groove thereby to reinforce said joint.

* * * * *